US009942685B2

(12) United States Patent
Middlemiss et al.

(10) Patent No.: US 9,942,685 B2
(45) Date of Patent: Apr. 10, 2018

(54) NAVIGATION WITH THREE DIMENSIONAL AUDIO EFFECTS

(71) Applicant: Microsoft Corporation, Redmond, WA (US)

(72) Inventors: Simon Middlemiss, Newbury (GB); Stuart McCarthy, Reading (GB); Michael Tsikkos, Reading (GB); Jarnail Chudge, Reading (GB); Amos Miller, London (GB)

(73) Assignee: Microsoft Technology Licensing, LLC, Redmond, WA (US)

( * ) Notice: Subject to any disclaimer, the term of this patent is extended or adjusted under 35 U.S.C. 154(b) by 53 days.

(21) Appl. No.: 13/931,468

(22) Filed: Jun. 28, 2013

(65) Prior Publication Data

US 2015/0003616 A1 Jan. 1, 2015

(51) Int. Cl.
*H04S 7/00* (2006.01)

(52) U.S. Cl.
CPC ..... *H04S 7/303* (2013.01); *H04R 2499/11* (2013.01); *H04S 2400/11* (2013.01)

(58) Field of Classification Search
CPC ..... H04S 5/00; H04S 5/005
USPC ..... 381/17; 715/716; 700/94; 704/500; 340/539, 989; 455/556.1, 404.2, 456.3, 455/456.6; 701/441, 533, 201, 202, 210; 372/6
See application file for complete search history.

(56) References Cited

U.S. PATENT DOCUMENTS

| | | | | |
|---|---|---|---|---|
| 6,401,028 | B1 * | 6/2002 | Kamiya | G01C 21/36 701/441 |
| 8,095,303 | B1 * | 1/2012 | Nesbitt | G01C 21/343 701/533 |
| 2008/0162034 | A1 * | 7/2008 | Breen | G01C 21/26 701/533 |
| 2010/0241350 | A1 | 9/2010 | Cioffi et al. | |
| 2011/0172907 | A1 | 7/2011 | Rui Da Silva Freitas | |
| 2012/0124470 | A1 | 5/2012 | West et al. | |
| 2012/0223843 | A1 | 9/2012 | Wall et al. | |
| 2014/0079225 | A1 * | 3/2014 | Jarske | H04R 29/00 381/56 |

(Continued)

OTHER PUBLICATIONS

Delphine Szymczak, Designing Guidance along Audio/haptically Augmented Paths in a City Environment, In the Thesis of Licentiate, Dec. 16, 2011, 136 pages, Lund University, Lund, Sweden; http://lup.lub.lu.se/luur/download?func=downloadFile&recordOld=2214110&fileOld=2223936.

(Continued)

*Primary Examiner* — Md S Elahee

(57) ABSTRACT

Mechanisms for navigation via three dimensional audio effects are described. A current location of a device and a first point of interest are determined. The point of interest may be determined based on a web service and the current location of the device may be determined via mobile device signals. A zone that includes the point of interest may be determined. A three dimensional audio effect that simulates a sound being emitted from the zone may be generated. The three dimensional audio effect may be transmitted to speakers capable of simulating three dimensional audio effects. The transmitted three dimensional audio effect may aid in navigation from a current location to the point of interest.

20 Claims, 10 Drawing Sheets

(56) References Cited

U.S. PATENT DOCUMENTS

2014/0270182 A1* 9/2014 Vilermo ..... H04S 7/303
381/17

OTHER PUBLICATIONS

Kirsten Rassmus-Grohn, et al, An Audio-Haptic Mobile Guide for Non-Visual Navigation and Orientation, Lund University, In the 5th International Workshop on Haptic and Audio Interaction Design (HAID), Sep. 16, 2010, 3 pages, Lund University, Lund, Sweden, http://www.english.certec.lth.se/haptics/HaptiMap/37-AudioHapticGuide-print.pdf.

Ramiro Velazquez, Wearable Assistive Devices for the Blind, Wearable and Autonomous Biomedical Devices and Systems for Smart Environment: Issues and Characterization (Lecture Notes in Electrical Engineering vol. 75), Oct. 6, 2010, 17 pages, Springer, Germany; http://www.robotica-up.org/PDF/Wearable4Blind.pdf.

Sylvain Cardin, et al, Wearable System for Mobility Improvement of Visually Impaired People, In the Visual Computer: International Journal of Computer Graphics vol. 23 Issue 2, Jan. 2007, 11 pages, Springer-Verlag, United States, http://infoscience.epfl.ch/record/99038/files/VisualComputer.pdf.

Microsoft, A Family Day Out video, Inspiring future technologies for everyone, Guide Dogs, uploaded on Oct. 3, 2012, accessed Jun. 28, 2013; http://www.youtube.com/watch?v=-FcwzLLYZil&feature=player_embedded.

Microsoft, Inspiring future technologies for everyone, Guide Dogs, accessed Jun. 28, 2013; http://www.guidedogs.org.uk/inspiring-future-technologies/.

Stereophonic Sound, Wikipedia, accessed Jun. 28, 2013; https://en.wikipedia.org/wiki/Stereophonic_sound.

Kinect, Wikipedia, accesed Jun. 28, 2013; http://en.wikipedia.org/wiki/Kinect.

* cited by examiner

NAVIGATION WITH THREE DIMENSIONAL AUDIO EFFECTS

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

Embodiments herein relate to generation of three dimensional audio effects for navigation. Computer-related methods and systems described herein may be used to navigate, such as by vehicle or via walking with a mobile device. Embodiments herein may be used in conjunction with services, such as a search service for finding points of interest.

Three dimensional audio effects may be generated that simulate a sound coming from another point in two or three dimensional space. As such, three dimensional audio may lead to finding items of interest in a more efficient and fast way than mere voice commands.

A technical advantage of generation of three dimensional audio effects includes a more descriptive way of relaying navigation commands for a user. To the extent a navigation command comprises only a textual message, or an audio signal with a limited range of pitch that does not represent the path to a point of interest, it does not represent the direction, distance from a point of interest, or angles in three dimensions between the location of the device in use and the point of interest. As such, a technical advantage may include more efficiency and ease of use for a user to reach a destination. Because three dimensional audio effects may allow a user or vehicle to reach a destination point of interest in a more efficient way, it may save on energy consumption—it may save fuel or electricity consumption.

A technical advantage may also include use of a service to generate a three dimensional audio effect. The processing power needed to generate a three dimensional audio effect may be extensive, and so offloading the processing to a service. The service may be remote from a device used to emit the actual three dimensional audio effect.

Yet another technical advantage may include associating a three dimensional audio effect with a zone. Computation of a three dimensional audio effect may be expensive in terms of processor cycles, memory, power consumption for mobile device use, and other machine resources. It may be inefficient to calculate a different three dimensional audio effect every time a current location changes with respect to a point of interest. To the extent a point of interest continues to fall into a zone, a three dimensional audio effect may not need to be re-calculated, and this saves on power consumption, memory, processor cycles or other vital machine resources.

Still further, a technical advantage of zones may be that it reduces the cognitive load on a user hearing three dimensional sound effects. The ability to distinguish finely grained sound effects that vary slightly may cause confusion and distraction, and thereby make a user more inefficient. By producing a sound effect from a zone, it may allow a user to more easily discern the general area or volume in which a point of interest is located.

Many of the attendant features will be more readily appreciated as the same become better understood by reference to the following detailed description considered in connection with the accompanying drawings.

BRIEF DESCRIPTION OF THE DRAWINGS

Like reference numerals are used to designate like parts in the accompanying drawings.

DETAILED DESCRIPTION

The detailed description provided below in connection with the appended drawings is intended as a description of present examples and is not intended to represent the only forms in which the present examples may be constructed or utilized. The description sets forth functions of the examples and sequence of steps for constructing and operating the examples. However, the same or equivalent functions and sequences may be accomplished by different examples.

Figure 1:
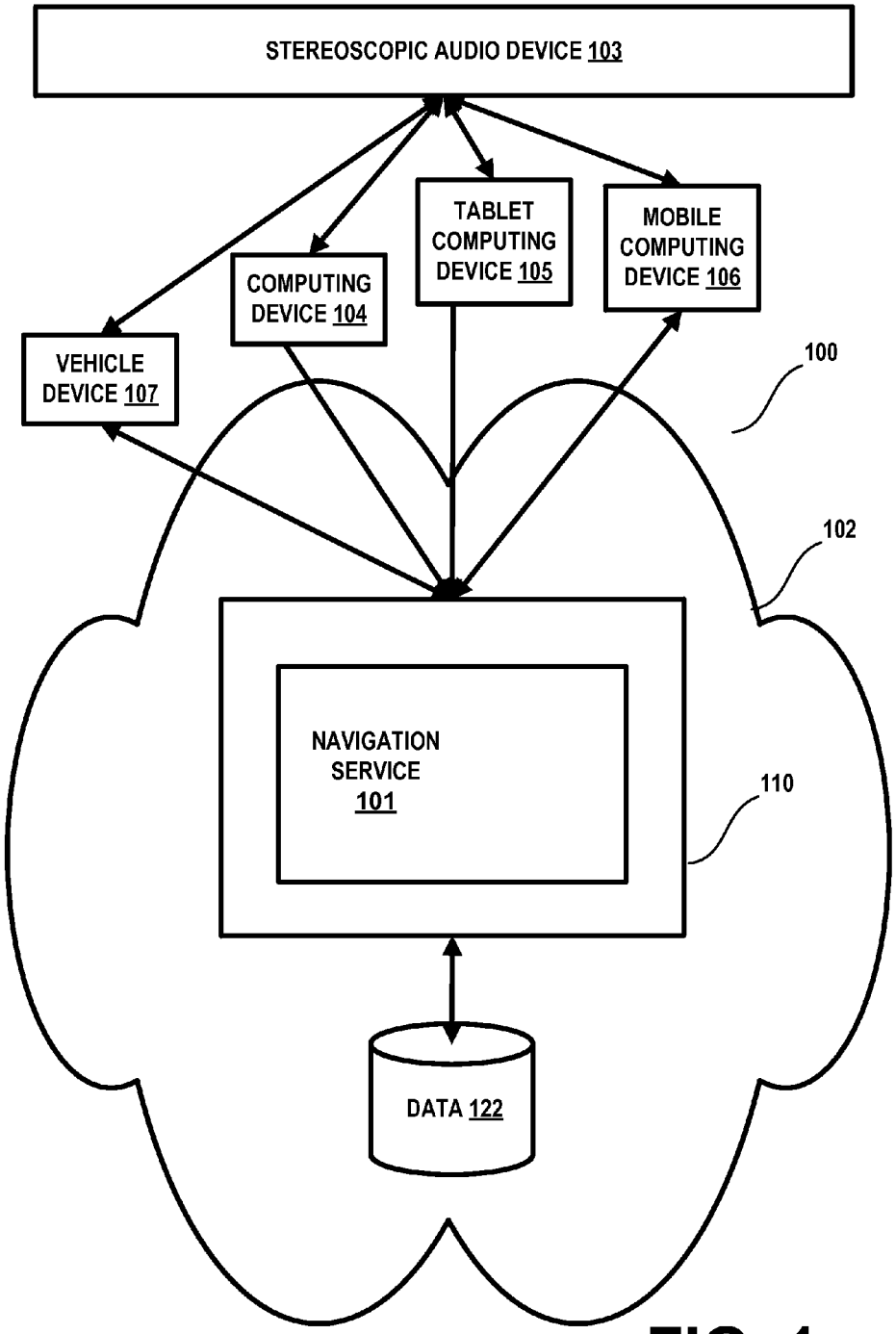
FIG. 1 is a block diagram of an example operating environment for implementing embodiments of the invention.

FIG. 1 shows an embodiment of an operating environment 100 for implementing embodiments of the invention. FIG. 1 and the following discussion are intended to provide a brief, general description of a suitable computing environment to implement embodiments of the invention. The operating environment 100 is only one example of a suitable operating environment. FIG. 1 illustrates a navigation service 101 implemented on one or more servers, but it is to be appreciated that the navigation service 101 may also just be a process executing on one or more client computing systems, or still further, it may execute on a combination of client and server computing systems.

Referring to FIG. 1, operating environment 100 may include a network 102. Network 102 may be the internet, or network 102 may comprise an intranet, and the like. A navigation service 101 may communicate with computing devices 104, 105, 106, 107 or any other computing device over network 102. An example computing device is described below in connection with FIG. 2. Computing device 104 may include any type of personal computer, such as a desktop computer, personal computer, mainframe computer, and the like. Computing device 104 may run operating systems such as for example MICROSOFT WINDOWS, GOOGLE CHROME, APPLE IOS, or any other computer operating system. Tablet computing device 105 includes slate or tablet devices that may be personally carried and used for browsing or viewing online services. Examples of a tablet computing device 105 may include a MICROSOFT SURFACE, APPLE IPAD, SAMSUNG GALAXY computers, or any other tablet computing device 105 that may be capable of being personally carried. Mobile computing device 106 may include smart phones, or other mobile computers. Mobile computing device 106 may be similar to a tablet computing device 105, or may have a smaller screen. Examples of mobile computing devices are smart phones running MICROSOFT WINDOWS PHONE operating system, APPLE IPHONES, or mobile phones running GOOGLE ANDROID, or any other phone running any other operating system. Vehicle device 107 may be any device integrated with a mobile vehicle. For example, vehicle device 107 may be a Global Positioning System (GPS) integrated with, or portably attached with, a car, a boat, an airplane, or any other vehicle. Each computing device 104-107 may be used to access the navigation service described herein—whether the navigation service is locally installed with the device or whether the service is provided over network 102.

Still referring to FIG. 1, operating environment 100 may include an exemplary server or servers 110 configured to provide navigation service 101. Navigation service 101 may send binary data, text data, eXtensible Markup Language (XML) data, Hypertext Markup Language (HTML), Simple Object Access Protocol (SOAP), Remote Procedure Calls (e.g., for local process calls on a local computer) or other messages or web service calls in any protocol to the client devices 104-107. Navigation service 101 may be configured to communicate with a data source 122. Data source 122 may store the data related to points of interest and/or current location for devices 104-107.

Still referring to FIG. 1, devices 104-107 may include a stereoscopic audio device 103 or be able to send audio messages to a stereoscopic audio device 103. Stereoscopic audio device 103 may be capable of reproducing three dimensional audio effects. Specifically, three dimensional audio effects may simulate a sound coming from a point distant from a listener—the point distant from the listener may be at a point different in the x-y horizontal plane, and optionally, it may also simulate coming from a point distant in the x-z vertical plane. As just one example, a three dimensional audio device 103 may be able to simulate a sound that is coming from a point behind and below a listener. In another embodiment, three dimensional audio device 103 may simulate a sound coming from a point to the left and below the listener. In just one exemplary embodiment, the three dimensional sound effect may be achieved by manipulating a relationship between a center signal and a side signal.

Figure 2:
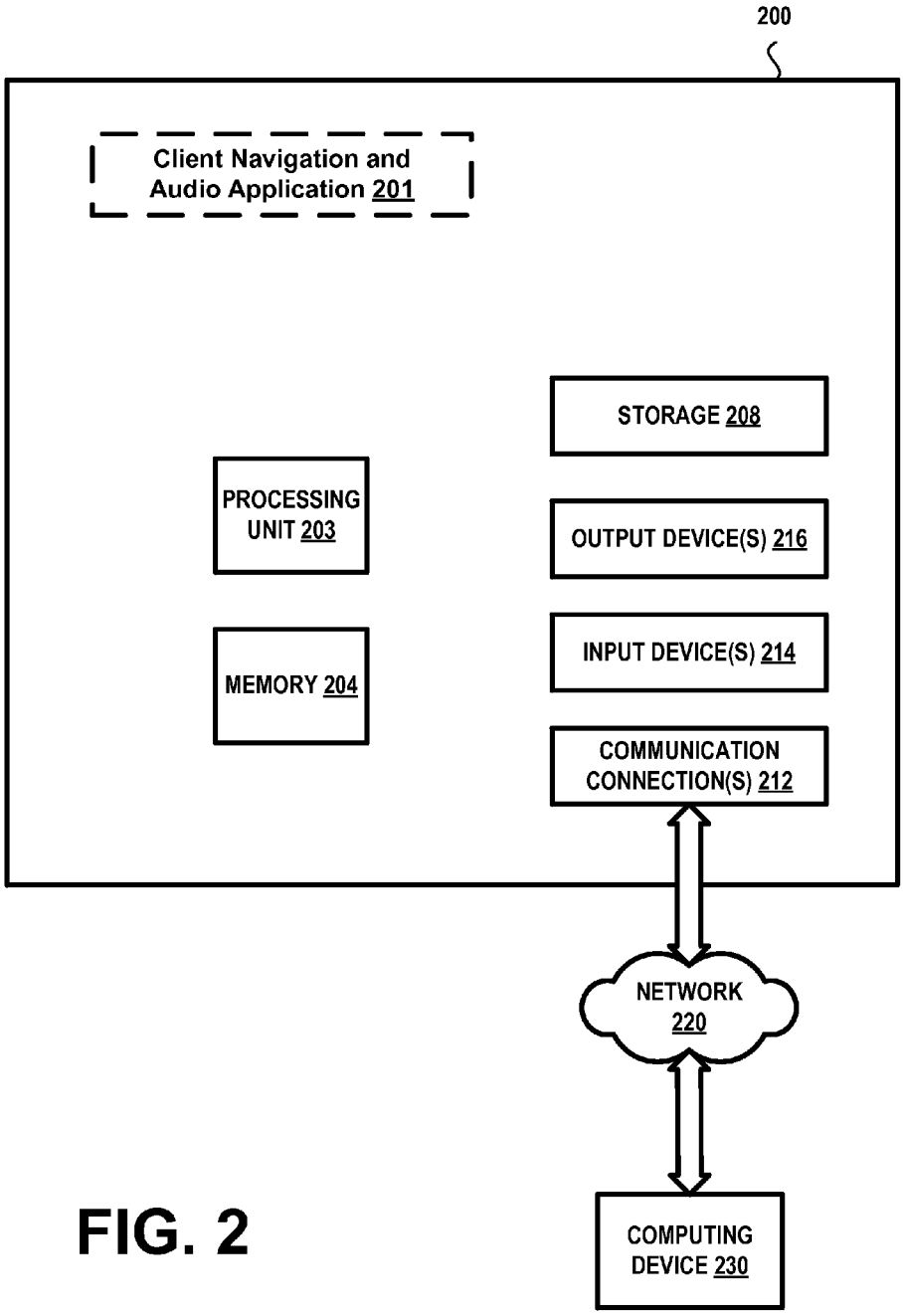
FIG. 2 is a block diagram of an example computing device for implementing embodiments of the invention.

FIG. 2 shows an embodiment of a local client computing device 200 for using one or more embodiments of the invention. FIG. 2 illustrates a computing device 200 that may display or use navigation information on the computing device 200 itself, or send or receive data representations related to navigation. Computing device 200 may be a personal computer, a mobile device computer, a tablet device computer, a system on a chip, a vehicle computer, or any other computing device. In one embodiment, computing device 200 may be used as a client system that receives navigation information from a remote system. In its most basic configuration, computing device 200 typically includes at least one processing unit 203 and memory 204. Depending on the exact configuration and type of computing device, memory 204 may be volatile (such as RAM), non-volatile (such as ROM, flash memory, etc.) or some combination of the two. Computing device 200 may run one or more applications. In FIG. 2, an exemplary client navigation and audio application 201 is depicted. Client navigation and audio application may be a web application running in a browser, a native application run on an operating system, a component of an operating system, a driver, or any other piece of software and/or hardware on the client device 200. Client navigation and audio application 201 may store data and instructions in memory 204 and use processing unit 203 to execute computer instructions.

Additionally, computing device 200 may also have additional hardware features and/or functionality. For example, still referring to FIG. 2, computing device 200 may also include hardware such as additional storage (e.g., removable and/or non-removable) including, but not limited to, solid state, magnetic, optical disk, or tape. Storage 208 is illustrated in FIG. 2. In one embodiment, computer readable instructions to implement embodiments of the invention may be stored in storage 208. Storage 208 may also store other computer readable instructions to implement an operating system, an application program (such as an applications that run on the device 200), and the like.

Embodiments of the invention will be described in the general context of "computer readable instructions" being executed by one or more computing devices. Software may include computer readable instructions. Computer readable instructions may be distributed via computer readable media (discussed below). Computer readable instructions may be implemented as program modules, such as functions, objects, methods, properties, application programming interfaces (APIs), data structures, and the like, that perform particular tasks or implement particular data types. Typically, the functionality of the computer readable instructions may be combined or distributed as desired in various environments.

The term "computer readable media" as used herein includes computer storage media. "Computer readable storage media" includes volatile and nonvolatile, removable and non-removable media implemented in any method or technology for storage of information such as computer readable instructions, data structures, program modules, or other data. Memory 204 and storage 208 are examples of computer storage media. Computer readable storage media includes, but is not limited to, RAM, ROM, EEPROM, flash memory or other memory technology, CD-ROM, digital versatile disks (DVDs) or other optical storage, magnetic cassettes, magnetic tape, magnetic disk storage, or other magnetic storage devices, solid-state drives, or NAND-based flash memory. "Computer readable storage media" does not consist of a "modulated data signal." "Computer readable storage media" is "non-transient," meaning that it does not consist only of a "modulated data signal." Any such computer storage media may be part of device 200.

The term "computer readable media" may include communication media. Device 200 may also include communication connection(s) 212 that allows the device 200 to communicate with other devices, such as with other computing devices through network 220. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency, infrared, and other wireless media.

Computing device 200 may also have input device(s) 214 such as a keyboard, mouse, pen, voice input device, touch input device, gesture detection device, laser range finder, infra-red cameras, video input devices, and/or any other input device. Input device(s) 214 may include input received from gestures or by touching a screen. For example, input device(s) 214 may detect swiping the screen with a finger, or one or more gestures performed in front of sensors (e.g., MICROSOFT KINECT). Output device(s) 216 includes items such as, for example, one or more displays, projectors, speakers, and printers. Output device(s) 216 may include speakers capable of simulating three dimensional audio effects.

Those skilled in the art will realize that computer readable instructions may be stored on storage devices that are distributed across a network. For example, a computing device 230 accessible via network 220 may store computer readable instructions to implement one or more embodiments of the invention. Computing device 200 may access computing device 230 and download a part or all of the computer readable instructions for execution. Communication connection 212 and network 220 may be used to facilitate communication between computing device 200 and computing device 230. Network 220 may include the internet, intranet, or any other network. Alternatively, computing device 200 may download pieces of the computer readable instructions, as needed, or some instructions may be executed at computing device 200 and some at computing device 230. Display representations may be sent from computing device 200 to computing device 230 or vice versa. Those skilled in the art will also realize that all or a portion of the computer readable instructions may be carried out by a dedicated circuit, such as a Digital Signal Processor (DSP), system on a chip, programmable logic array, and the like.

Example Navigation Service Architecture

Figure 3:
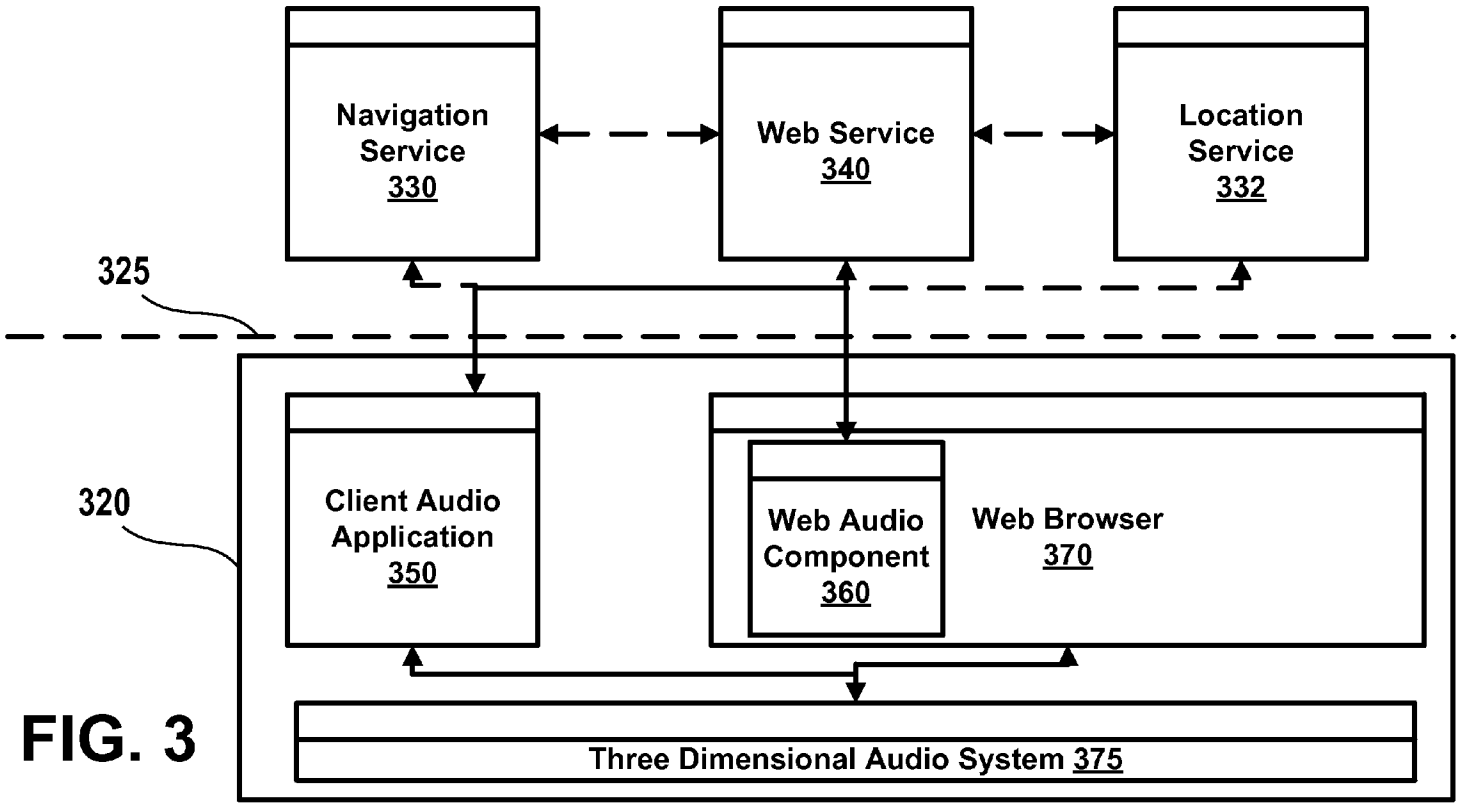
FIG. 3 is a component diagram for a service or process embodiment of the invention.

Embodiments of the invention provide a mechanism for navigation via three dimensional audio effects. Referring to FIG. 3, an example architecture for the use of a navigation service or navigation process is depicted. The services and components depicted in FIG. 3 may be modules, components or libraries of a system that is run locally, or they may be components and services run on a distributed architecture.

Still referring to FIG. 3, a client audio application 350 is illustrated as running on a client device 320. Client audio application 350 may be an application that calls operating system methods/Application Programming Interfaces (APIs), it may be a component of an operating system, such as a driver, hardware on client device 320, or any other component. Client audio application 350 may perform any function. In one embodiment, client audio application 350 may emit audio that simulates directions or sounds emanating from a point of interest. Optionally, client device 320 may run a web browser 370, or other internet application. The web browser 370 may run a client browser component 360. Browser component 360 may comprise a browser plug-in, script code (e.g., JavaScript) or any other component of the web browser 370. The browser component 360 may receive navigation and/or three dimensional audio effects to play. Device 320 may also include a three dimensional audio system 375. Three dimensional audio system 375 may simulate three dimensional audio effects. For example, three dimensional audio system 375 may simulate a sound as if the sound came from a distant point in the horizontal, and optionally, also in the vertical plane relative to the current location of the device.

FIG. 3 depicts a navigation service 330 and location service 332. Navigation service 330 may provide directions between a current location and one or more points of interest. In addition, navigation service 330 may provide three dimensional audio effects to simulate a sound coming from a point of interest relative to the current location of the client device 320. Location service 332 may provide information about a current location of device 320. Location service 332 may provide the information to web service 340, which in turn forwards the information to client device 320 or location service 332 may provide the location information directly to client device 320. Similarly, navigation service 330 may provide navigation information directly to device 320 or via web service 340. Boundary 325 may represent a boundary between components operating on a local device (i.e., services 330, 332, and 340 may all run on device 320) or the services 330, 332, and 340 may be remote services and boundary 325 may be a network boundary.

Still referring to FIG. 3, client application 350 and/or web audio component 360 may communicate directly with navigation service 330, or to the navigation service 330 via a web service 340. As an example, a maps web service may interoperate with navigation service 330, and return three dimensional audio messages to client application 350 and/or web audio component 360. As stated previously, navigation service 330 may run on the client device 320 or on a separate server device. Although client browser component 360 may communicate with web service 340, client browser component 360 may or may not be receiving web pages. As just one example, client browser component 360 may be using a protocol and receiving informational messages via the protocol. In turn, in the embodiment depicted by FIG. 3, web service 340 may communicate with navigation service 330.

In FIG. 3, web service 340 may be an internet server for receiving and transmitting Hypertext Transfer Protocol (HTTP), Simple Object Access Protocol (SOAP), Representational State Transfer (REST) protocol, Transfer Control Protocol/Internet Protocol (TCP/IP), File Transfer Protocol (FTP), a WebSocket protocol, or any other network protocol. In one embodiment, web service 340 is a HTTP server for serving web pages to client browsers. For example, in one embodiment, client browser 370 may be navigated to a web page to allow viewing current location in relation to points of interest, and web audio component 360 may concurrently give three dimensional audio directions.

Three Dimensional Audio Navigation

Figure 4A:
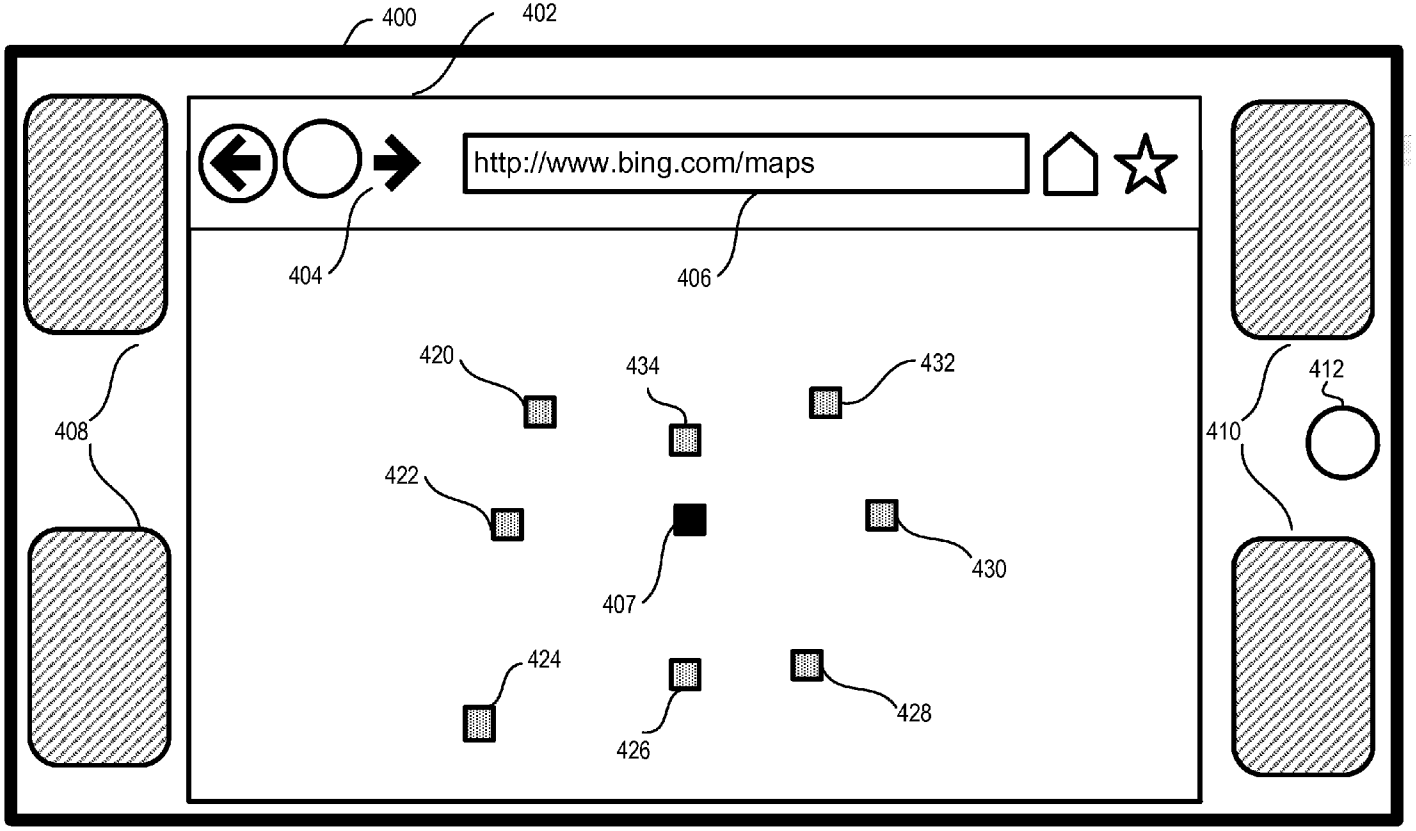
FIG. 4A is an exemplary graphical user interface for display of points of interest relative to a current location, and illustrates audio speakers that may simulate three dimensional audio.

FIG. 4A illustrates an exemplary graphical user interface and an exemplary mobile device for receiving information about points of interest. A mobile device 400 may run a browser or local application 402. Control 412 may aid in accessing the application 402 (e.g., a control to access the main menu of applications available on the device 400). Application 402 may be a browser, such as for example GOOGLE CHROME, MICROSOFT INTERNET EXPLORER, FIREFOX, APPLE SAFARI or any other application used to view internet documents. Controls 404 may allow navigation to a Universal Resource Location (URL) 406. Universal Resource Location (URL) 406 may be used to access map information from a web service, and a web page returned by the web service may display points of interest in relation to a current location of the device 400. Controls 404 may allow navigation between URLs.

In the example of FIG. 4A, various points of interest 420, 422, 424, 426, 428, 430, 432 and 434 may have been received and displayed. In addition, a representation of the current location of the device 407 may be displayed. The points of interest may have been automatically generated based on the user associated with accessing the web service and current location of the device. As an example, if the web service has received the user identifier associated with the device, and the web service has access to data about the user—such as likes and dislikes—the web service may return points of interest related to the likes or preferences of the user. For example, if the user likes coffee, the points of interest may depict coffee stores nearby. As another example, the web service may have received a selection of interests by the user, via a search query or otherwise. As an example, the user of the device may have searched for coffee stores and points of interest 420, 422, 424, 426, 428, 430, 432 and 434 may be the results. Still further, the web service may take into account the context at the time of the request. Context may include user preferences, but it may also include other factors such as the time of day, the location of the user, the weather, the nature of the request. As an example, if the user enjoys both bottled water and coffee, but the weather is hot and the request for a beverage comes in the early evening, the service may return points of interest selling bottled water.

Still referring to FIG. 4A, speakers 408 and 410 depict speakers capable of playing three dimensional audio effects. The speakers may be on the front and back of the device, and/or positioned elsewhere. Clearly, speakers 408 and 410 may also include headphones, earphones, or any other speakers that are attached or interoperate (wirelessly or otherwise) with the device 400.

An aspect of the embodiment depicted in FIG. 4A is that speakers 408 and 410 may produce sounds that simulate coming from a direction and distance of one or more points of interest relative to the current location of the device. The device 400 may play the three dimensional sound effects in succession, or it may play a three dimensional sound effect associated with the point of interest closest to the current location of the device 400. As an example, device 400 may play a first sound effect that simulates being a short distance north of the user that indicates point of interest 434. The three dimensional sound effect may include a tone or a series of tones, musical piece, or other sounds that indicates a zone of the point of interest. Still further, the three dimensional sound effect may be customized by the user or by the point of interest. For example, a user may select a type of sound to be emitted for certain types of location—e.g., for stores selling coffee. In addition, a point of interest may associate a three dimensional sound effect with a brand or type of service, and the device may download and use the sound effect. The device 400 may play a series of three dimensional audio effects, one for each point of interest. Similarly, the device 400 may play a three dimensional audio effect for the point of interest that is closest, or for a point of interest indicated as being a destination for the user.

Figure 4B:
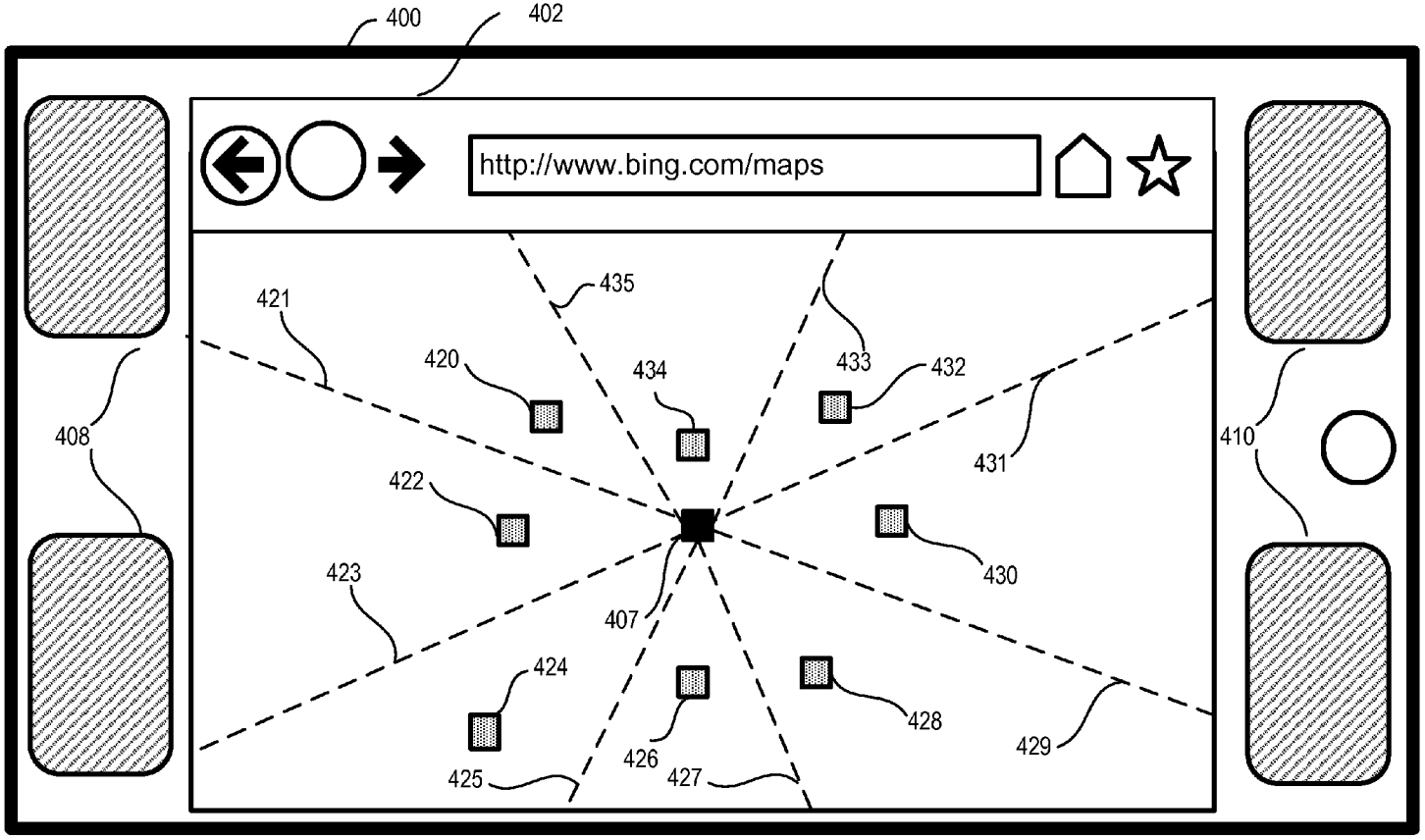
FIG. 4B is an exemplary graphical user interface for display of points of interest relative to a current location, and illustrates zones determined for points of interest.

FIG. 4B depicts the same device with example zones determined for points of interest. A zone may comprise a single point (the point of interest), a one dimensional line, a two dimensional area, or a three dimensional volume of points. The zone may extend from the current location of the device up to on or around a point of interest. After a point of interest has been classified into a zone, a three dimensional audio effect may be computed based on the zone. Points of interest within the same zone may have the same three dimensional sound effect associated with them.

Zones may be calculated using pre-set angles from the current location of the device or by determining shapes between the current location and around points of interest. In the example of FIG. 4B, a first zone is bounded within lines 421 and 435, and the zone includes point of interest 420. A second zone is bounded by lines 421 and 423, the line including point of interest 422. Other zones include those bounded by lines 423 and 425, 425 and 427, 427 and 429, 429 and 431, 431 and 433, and 433 and 435. In the example of FIG. 4B, points of interest 420, 422, 424, 426, 428, 430, 432 and 434 are each individually within a zone, and therefore each point of interest may have a different three dimensional audio effect associated with it. If two points of interest were each in the same zone, then they might have the same audio effect. As an example, if two points of interest were each in the zone bounded by lines 421 and 423, they may each have a similar sound effect simulating a sound from the left. Equally, they may each simulate being on the left but from different distances. For example, a point of interest further away from the current location may be at a lower volume to indicate the distance is further away, and the one closer may be louder—both would simulate being to the left of the user.

A zone may extend out to infinity or may be bounded by a distance as well as the lines emanating from the current location. As another example, a first zone may end at a short distance away from the current location, and a second zone may extend from that distance out to infinity. As described previously, a zone may include a three dimensional volume, such as a cone or it may include a two dimensional segment. A zone may also just be a point coincident with the point of interest—in that case, the sound effect varies for each point of interest in a different location because the zone is just a point.

Figure 4C:
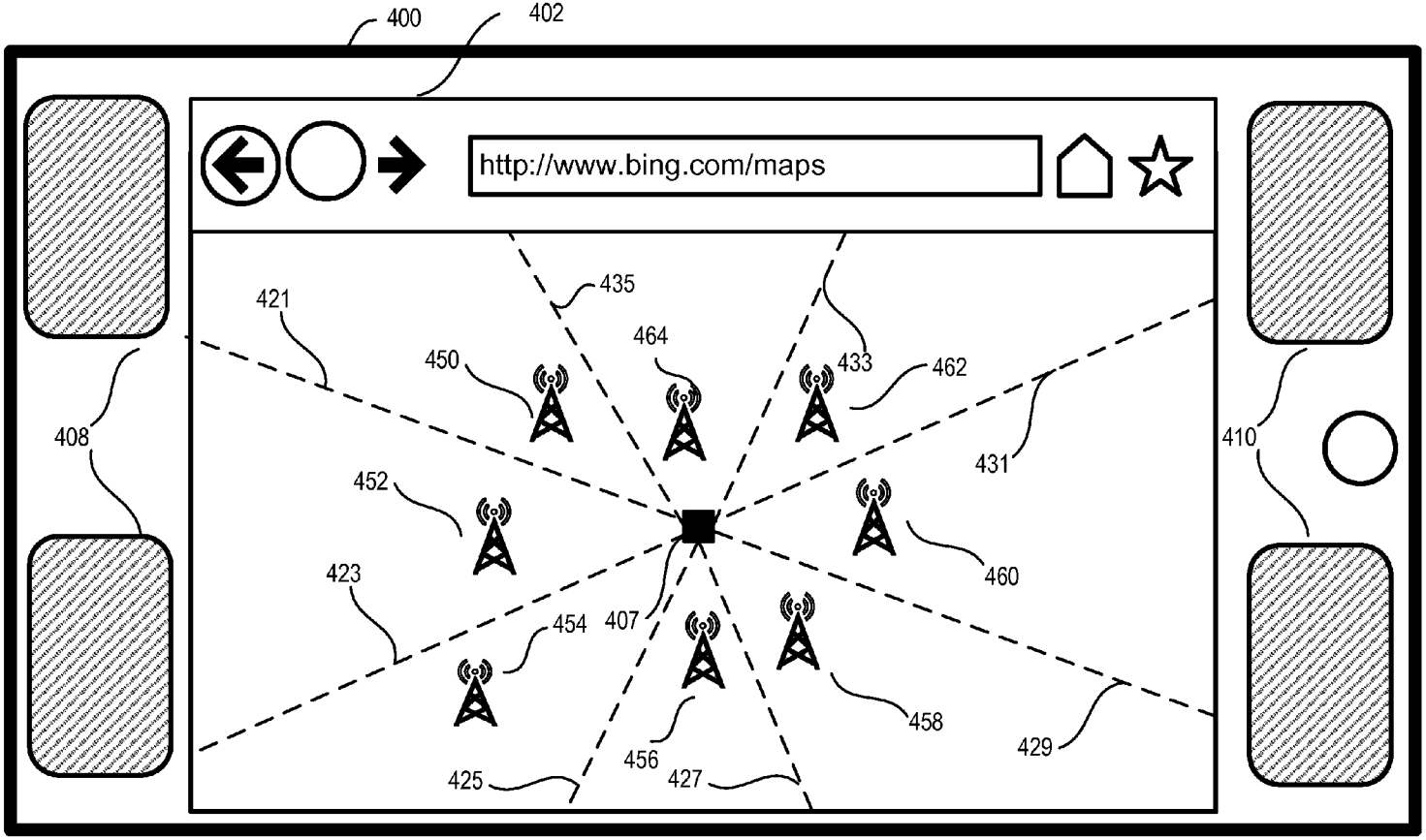
FIG. 4C is an exemplary graphical user interface for display of sound effects that may be associated with zones.

FIG. 4C is an exemplary graphical user interface for display of sound effects that may be associated with zones. In particular, a user may select a scan command to listen to sound effects associated with each zone. FIG. 4C includes sound effect symbols 450, 452, 454, 456, 458, 460, 462, and 464. Upon receiving a scan command, a system may reproduce a sound effect associated with each zone. Optionally, a system may highlight a sound effect in a zone so that the sound effect may be easily associated with the zone. In addition, or in the alternative, the system may play tones as the sound effects. For example, a system may play tones clockwise—starting at 456, and then going through 454, 452, 450, 464, 462, 460, and ending at 458. The system may give the lowest pitch to 454 and the highest pitch to 458. In the alternative, the system may attribute a highest pitch to sound effect 464 (North of the user's location) and associate the lowest pitch to 456, with both 454 and 458 having next lowest pitches.

Figure 4D:
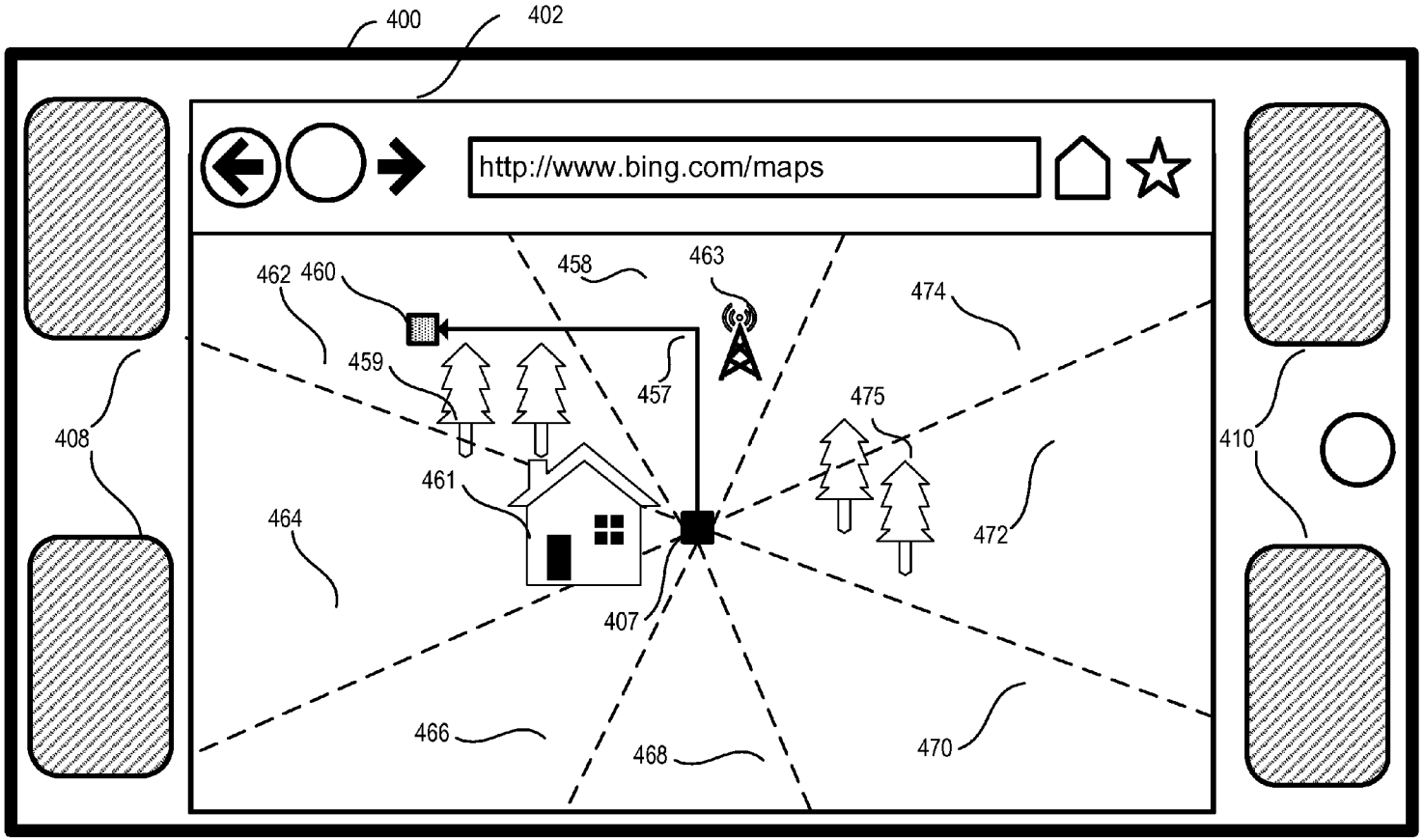
FIG. 4D is an exemplary graphical user interface for display of a path to a destination.

FIG. 4D is an exemplary graphical user interface for display of a path to a destination. Device's current location 407 is displayed. FIG. 4D includes zones 458, 462, 464, 466, 468, 470, 472, and 474. In the example of FIG. D, a user may have scanned for points of interest, and selected point of interest 460. Interestingly, in the example of FIG. 4D, the shortest path between device's current location 407 and point of interest 460 would involve traveling through obstacle trees 459 or building 461. Trees 475 also represent obstacles to other points of interest. The user may be aware of the obstacles and the sound effects associated with each zone behave as previously described (i.e., based on zone, without regard to obstacles). However, in another embodiment, the service may take into account obstacles and available paths based on the mode of transportation and context of the user, and the three dimensional sound effects may be customized based on these factors. For example, in FIG. 4D, the sound effect associated with zone 462 may be set so that it indicates it is not the correct direction to travel because the obstacles 459 and 461 would present problems. Instead, a three dimensional sound effect 463 may indicate a correct path since path 457 may coincide with a path (e.g., a foot path if for a pedestrian, or a road if for a car) and/or because path 457 avoids obstacles 459 and 461.

Figure 5:
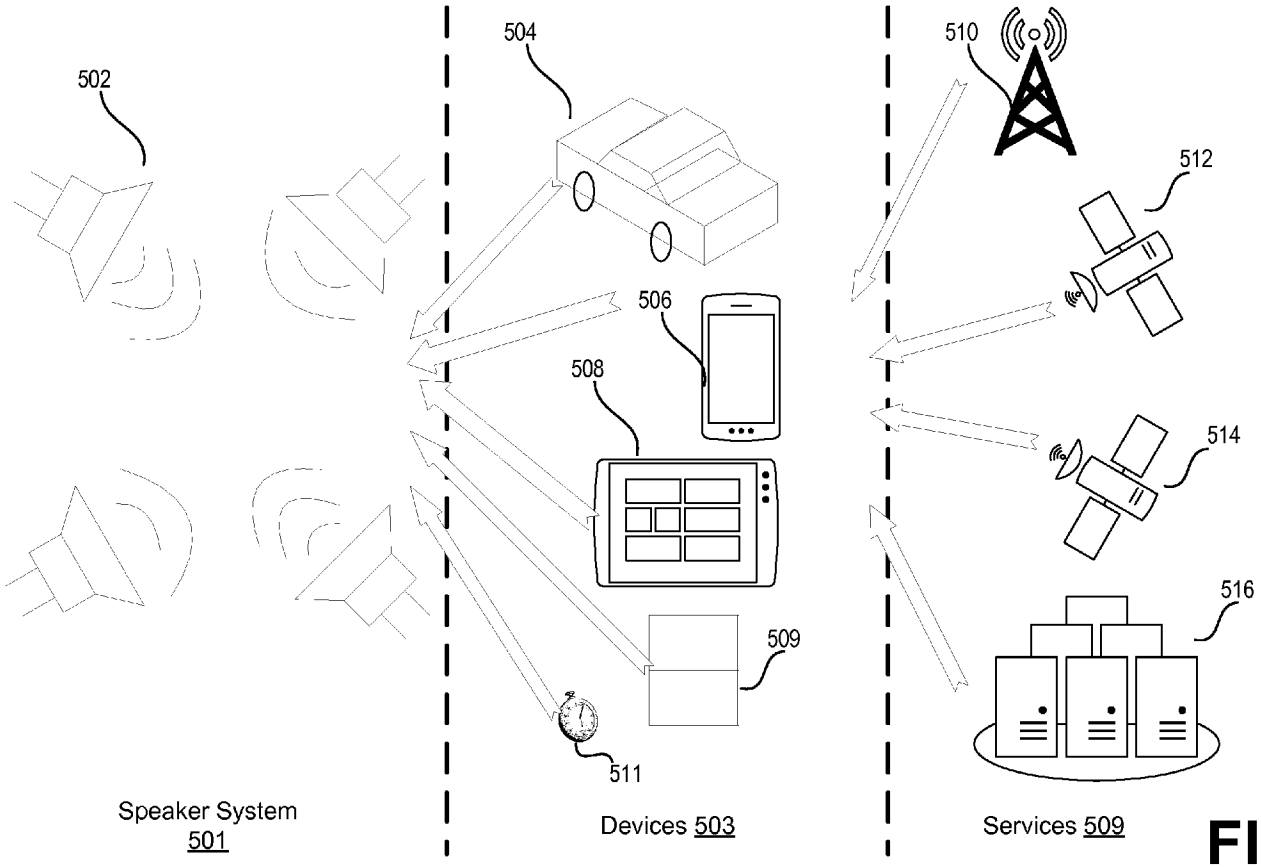
FIG. 5 illustrates some possible services, components and systems in an embodiment of the invention.

FIG. 5 shows an architecture diagram of services and devices interacting with speakers to aid a user in navigation with three dimensional audio effects. Speaker system 501 may be built into mobile devices or may be separated from the devices (e.g., headphones). Devices 503 may include vehicles such as automobiles 504, mobile phones 506, tablet computers 508, wearable devices 511 (e.g., a watch, a chain, a collar, a personal music player, a card or wallet with a system on a chip) or appliances or furniture within a house 509 (e.g., a refrigerator, a table, a lamp, a television etc.). Each of the devices may include a three dimensional audio system or be capable of sending audio signals to speakers capable of reproducing three dimensional audio effects. Devices 503 may receive signals from services 509. For example, cell towers 510 may send signals that allow for or aid a determination of current location and/or may pass along other service information (e.g., internet information). Current location and other information may also be received from satellites 512 and 514. Data center 516 is depicted as sending information to devices 503. Services running in the data center 516 may include a navigation service that determines location of points of interest and send those to be displayed on devices 503. Similarly, data center 516 may run a service that sends three dimensional audio effects to devices 503. As stated previously, however, navigation process may also run locally on devices 503.

Computer-Implemented Processes for Three Dimensional Audio Navigation

Figure 6:
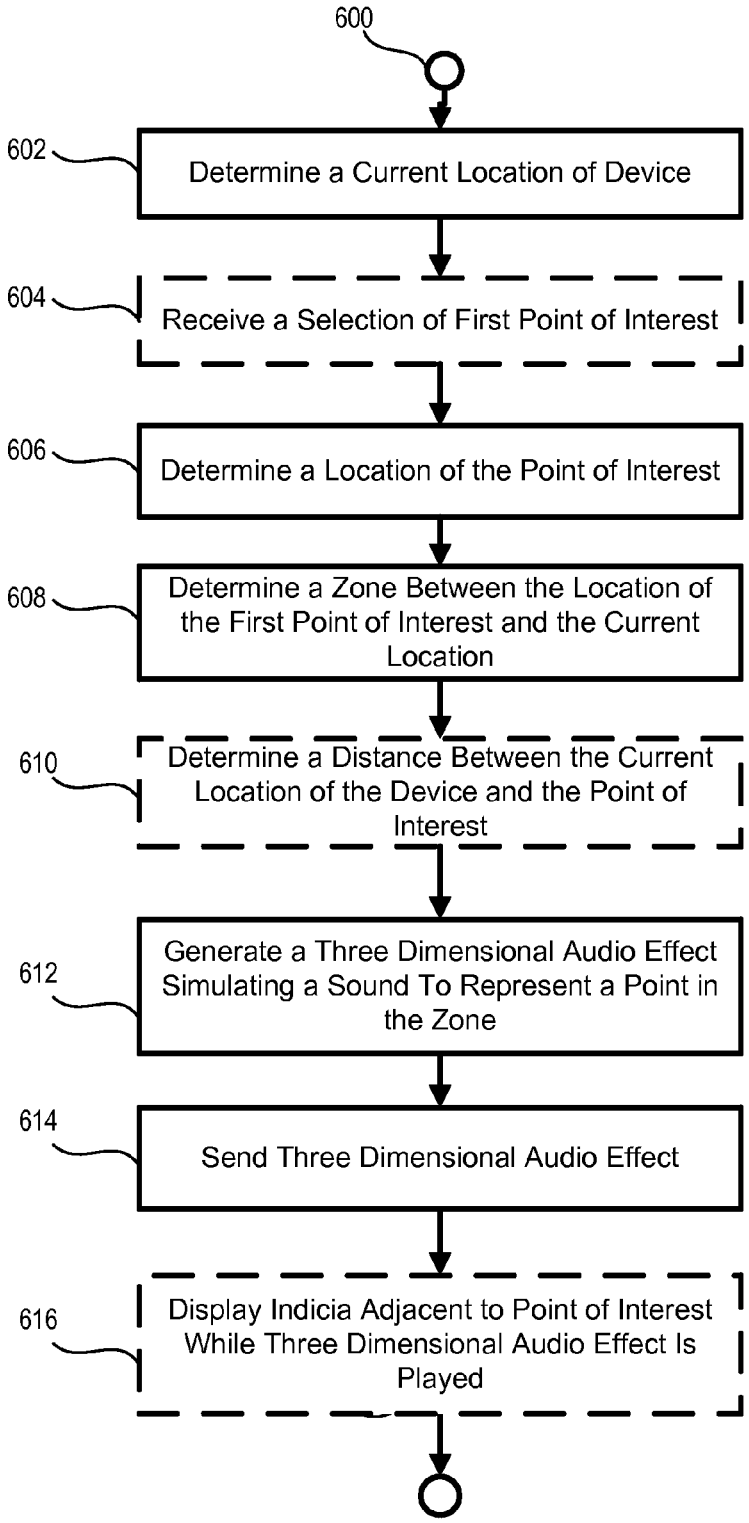
FIG. 6 illustrates a computer related method for generation of a three dimensional audio effect for navigation.

FIG. 6 illustrates a computer related method for generation of a three dimensional audio effect. At start stage 600 a user requests three dimensional audio effects in relation to current location. This may include starting a navigation process or a navigation service delivered over the network. The method depicted in FIG. 6 may be executed locally on a device, or it may be executed by a remote service receiving messages from a device, or it may be partially executed locally and partially executed remotely via a service.

Still referring to FIG. 6, at step 602, the computer method determines a current location of the device. As described in FIG. 5, determining a current location of the device may comprise analyzing mobile device signals, triangulating cell tower or other wireless signals, it may involve use of satellite signals, or any other method for determination of current location of a device. In another embodiment, determination of current location may be performed using devices in the mobile device—for example, a gyroscope, accelerometer and barometer may be used to determine current location by measuring changes that have occurred since a last known location. For example, a barometer may be useful to determine vertical position.

At step 604, the method may optionally receive points of interest. The points of interest may be directly specified via a user or may be indirectly determined via a search query for points of interest related to a genre (e.g., restaurants, entertainment, shopping or other attractions). The location of the point of interest may be determined by sending a web service request with an identifier associated with the first point of interest and receiving a location associated with the first point of interest. As just some examples, web service requests for a point of interest may be sent to search engines such as MICROSOFT BING, GOOGLE SEARCH, YAHOO SEARCH, BAIDU SEARCH, or any other search and/or map service. At step 606, the method may determine the location of a first point of interest (e.g., by conversion of a mail address or name of a premise to a geographical location). The point of interest may then be displayed relative to a current location. The point of interest may also be within buildings—for example, it may include an office, fire escape, meeting location in a building, a location within a mall, or any other indoor point of interest. Buildings may provide the service for location of indoor points of interest via ultra-wideband or other wireless service.

Points of interest in step 604 may also include items within a room. For example, points of interest may include furniture and other items within a room. The signals of the points of interest may be received from passive or active Radio Frequency Identifiers or other devices embedded with items in the room. For example, the points of interest in step 604 may be individual items of personal property—e.g., the method may be used to locate car keys within a crowded room. A point of interest may also be a person. For example, people may wear badges giving a passive or active signal when scanned, and the person of interest may be identified in step 604. Points of interest in step 604 may also be acquired via cameras coupled with recognition. For example, by pointing a MICROSOFT KINECT device around a room, items with dimensions may optionally be identified or recognized and the computer implemented method may be used to navigate towards a point of interest (or, in fact, it may be used to navigate away from points that are not of interest).

Still referring to FIG. 6, at step 608, a zone may be determined between the current location of the device and the location of the point of interest. The zone may be coincident with the point of interest itself, a straight line between the point of interest and the current location, or it may be an area or volume that contains the current location and the point of interest. In one embodiment, a zone may be determined by determining a first angle, the first angle measured in a horizontal plane between the current location of the device and the location of the first point of interest and then determining a second angle, the second angle measured in a vertical plane between the current location of the device and the location of the first point of interest. The three dimensional audio effect may simulate a sound emitted from a point that is on a first line at the first angle and a second line at the second angle.

The zone may also be a volume of points encapsulating the current location of the device, the location of the first point of interest, points adjacent to a line between the current location of the device and the location of the point of interest. In one embodiment, the zone may be substantially in a shape of a cone in three dimensions or, in another embodiment, the zone may be in a shape of a segment in two dimensions. For example, the segment may include area between two intersecting lines and a circular arc, straight line or other line or lines between the intersecting lines. Regardless, the zone may be any geometric shape.

The three dimensional sound effect to be played to represent how to find the point of interest may be varied based on the zone that contains the point of interest. For example, the computer implemented method may determine a pitch of the three dimensional audio effect based on the first angle, the second angle, and a distance between the current location and the point of interest. In another embodiment, the frequency of sound pulses may vary based on the zone that the point of interest in located. In other embodiments, the frequency, pitch, volume, and other audio variables may all be varied based on the zone. In one embodiment, the sound effects based on a zone may vary based on a pentatonic or heptatonic scale. Notes from the musical scale may be at different tones or semitones based on the zone. As a point of interest becomes further away, the tone may shift and shift again as a user becomes nearer to the point of interest. In one embodiment, a tone to indicate closeness to a point of interest (or becoming closer) may be a low pitch soft tone, and a tone to indicate a point of interest is far away (or becoming further away) may be at a higher tone.

The computer implemented method may generate a three dimensional sound effect using an Application Programming Interface for a sound system. For example, MICROSOFT offers a MICROSOFT KINECT API that may allow simulation of three dimensional audio effects.

At step 610 of FIG. 6, the computer method may optionally determine a distance between the current location of the device and the point of interest. At step 612, the computer method may generate a three dimensional audio effect, the three dimensional audio effect representing a point in the zone. Optionally, the three dimensional audio effect may simulate a sound emanating from the point of interest that would be heard at the current location.

At step 612, the three dimensional audio effect may be sent to the device (if the method was executed by a service). If the method is executed by a remote service, the three dimensional audio effect may be sent via a web service message. The web service message may represent the three dimensional audio message in eXtensible Markup Language (XML) or via any other text or binary representation. In step 614, the three dimensional audio effect may be sent as a digital or analog signal to speakers capable of playing the three dimensional audio effect.

At optional step 616, the point of interest may be displayed with indicia while the three dimensional audio effect is played. For example, concentric circles or a glyph may be displayed near or over the point of interest while the three dimensional audio effect is being simulated by the speakers.

Figure 7:
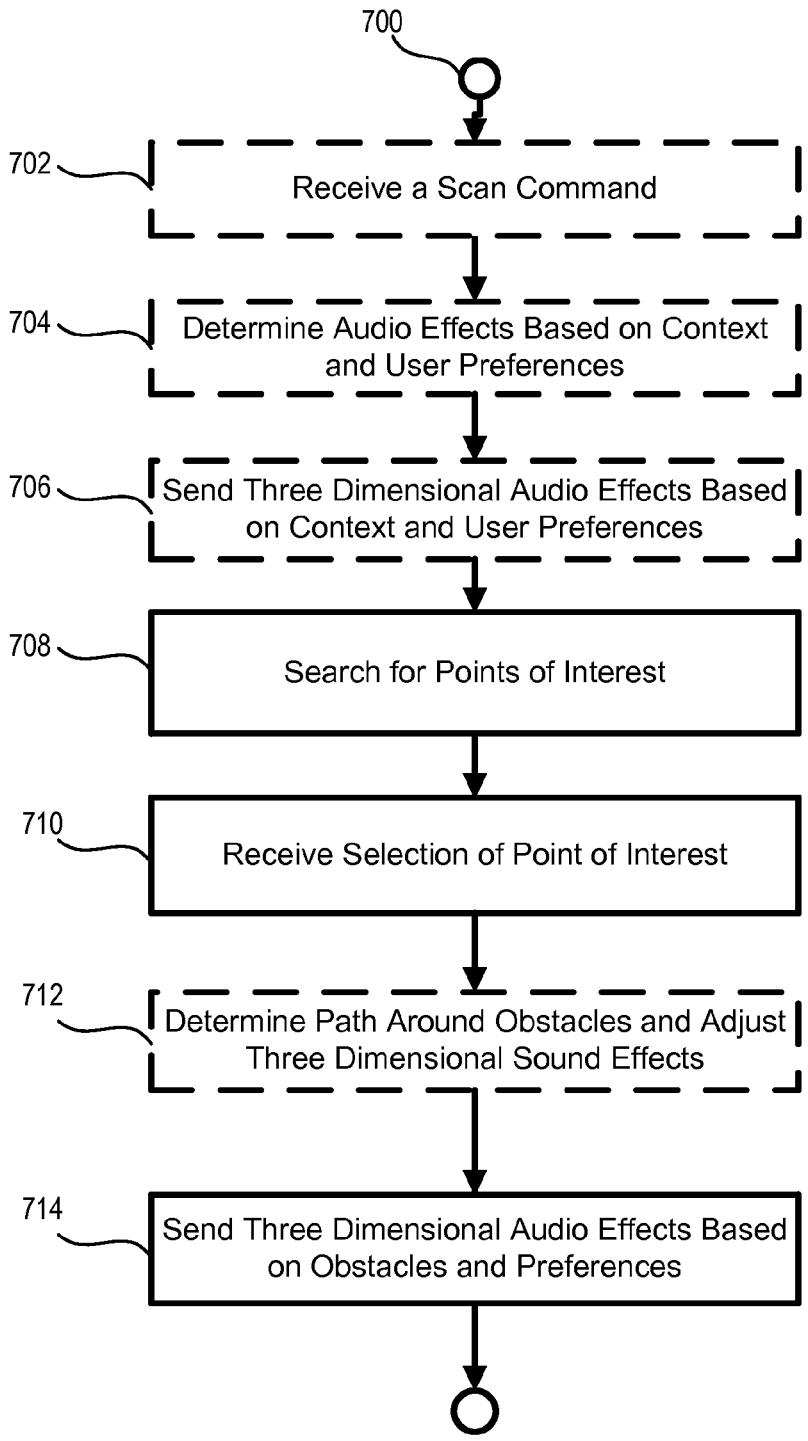
FIG. 7 illustrates another computer related method for generation of a three dimensional audio effect for navigation.

FIG. 7 illustrates another computer related method for generation of a three dimensional audio effect. At start stage 700 a user may want to navigate a point of interest. At optional step 702, a navigation service may receive a command to scan zones. At optional step 704, the service may determine the context of the user (e.g., location, temperature, altitude, etc.) and the user preferences (e.g., preferences for audio effects) and associate three dimensional sound effects with zones. At optional step 706, the system may send three dimensional sound effects based on the context and/or user preferences for each zone. At step 708, a search for points of interest may be conducted, and at step 710 a point of interest may be selected. At step 712, the navigation service may determine a path around any obstacles. The navigation service may use the mode of transportation, user preferences, or any other indicia to again associate three dimensional sound effects with zones and/or directions. As explained previously, the three dimensional sound effects may be customized to give an optimal path that avoids obstacles. Finally, at step 714, the three dimensional sound effects that take into account obstacles may be sent for reproduction.

Various operations of embodiments of the present invention are described herein. In one embodiment, one or more of the operations described may constitute computer readable instructions stored on computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each embodiment of the invention.

The above description of embodiments of the invention, including what is described in the Abstract, is not intended to be exhaustive or to limit the embodiments to the precise forms disclosed. While specific embodiments and examples of the invention are described herein for illustrative purposes, various equivalent modifications are possible, as those skilled in the relevant art will recognize in light of the above detailed description. The terms used in the following claims should not be construed to limit the invention to the specific embodiments disclosed in the specification. Rather, the following claims are to be construed in accordance with established doctrines of claim interpretation.

What is claimed is:

1. A computer-implemented method comprising:

receiving a search request;

determining a current location of a mobile device;

determining a context associated with the current location of the mobile device, the context including an environmental condition associated with the current location;

scanning to identify a plurality of points of interest proximate to the current location of the mobile device, including (1) scanning to identify one or more search-related points of interest based on the search request, and (2) scanning to identify one or more environment-related points of interest based on both the environmental condition associated with the current location and the search request, the one or more environment-related points of interest not being identified during the scanning to identify one or more search-related points of interest;

determining a plurality of zones proximate the current location of the mobile device, each zone of the plurality of zones including at least one point of interest of the plurality of points of interest;

determining a location of the point of interest in an associated zone of the plurality of zones relative to the current location of the mobile device;

outputting to a speaker of the mobile device a plurality of three dimensional audio effects associated with the plurality of points of interest, the three dimensional audio effects of the plurality of three dimensional audio effects simulating a sound emitted from a direction and distance of an associated point of interest relative to the current location of the mobile device, at least one three dimensional audio effect of the plurality of three dimensional audio effects being at least partially determined based on the environmental condition associated with the current location of the mobile device;

receiving an indication of a selection of a destination point of interest of the plurality of points of interest in a zone of the plurality of zones;

determining a path from the current location of the mobile device to the location of the destination point of interest; and outputting to the speaker of the mobile device the three dimensional audio effect associated with the destination point of interest that indicates a correct direction of travel as the current location of the mobile device approaches the location of the destination point of interest.

2. The computer-implemented method of claim 1, wherein determining a location of the points of interest in an associated zone of the plurality of zones relative to the current location of the mobile device comprises:

sending a request to a remote web service with an identifier associated with the point of interest; and receiving the location associated with the point of interest.

3. The computer-implemented method of claim 1, wherein the environmental condition associated with the current location includes at least one of a temperature associated with the current location, a time of day associated with the current location, an altitude associated with the current location, or a weather condition associated with the current location.

4. The computer-implemented method of claim 1, wherein:

the three dimensional audio effects associated with the points of interest are provided via a web service message including the three dimensional audio effects associated with the points of interest.

5. The computer-implemented method of claim 1, wherein determining a path from the current location of the mobile device to the location of the destination point of interest comprises determining a location of at least one obstacle;

and wherein outputting to the speaker of the mobile device the three dimensional audio effect associated with the destination point of interest that indicates a correct direction of travel as the current location of the mobile device approaches the location of the destination point of interest comprises:

outputting to the speaker of the mobile device a first three dimensional audio effect associated with the destination point that leads into a first zone that does not include the destination point of interest to lead the mobile device along the correct direction of travel to avoid the at least one obstacle; and outputting to the speaker of the mobile device a second three dimensional audio effect associated with the destination point that leads into a second zone that does include the destination point of interest to lead the mobile device along the correct direction of travel to the destination point of interest.

6. The computer-implemented method of claim 1, further comprising:

determining a first angle, the first angle measured in a horizontal plane between the current location of the mobile device and a location of a first point of interest; and determining a second angle, the second angle measured in a vertical plane between the current location of the mobile device and the location of the first point of interest;

wherein the three dimensional audio effect associated with the first point of interest simulates sound emitted from a point at the first angle and the second angle.

7. The computer-implemented method of claim 6, further comprising:

determine a pitch of the three dimensional audio effect associated with the first point of interest based on the first angle, the second angle, and a distance between the current location of the mobile device and the first point of interest.

8. The computer-implemented method of claim 1, wherein each zone is a volume of points encapsulating the current location of the mobile device, the location of at least one point of interest, and points along a line between the current location of the mobile device and the location of the at least one point of interest.

9. The computer-implemented method of claim 1, wherein outputting to the speaker of the mobile device the three dimensional audio effect associated with the destination point of interest that indicates a correct direction of travel as the current location of the mobile device approaches the location of the destination point of interest comprises:

determining a three dimensional audio effect based on a relative zone location of the plurality of zones.

10. The computer-implemented method of claim 1, wherein the environmental condition associated with the current location includes a weather condition associated with the current location.

11. A system comprising:

at least one processing device configured by one or more instructions to perform operations including at least:

receiving a search request;

determining a current location of a mobile device;

determining a context associated with the current location of the mobile device, the context including an environmental condition associated with the current location;

scanning to identify a plurality of points of interest proximate to the current location of the mobile device, including (1) scanning to identify one or more search-related points of interest based on the search request, and (2) scanning to identify one or more environment-related points of interest based on both the environmental condition associated with the current location and the search request, the one or more environment-related points of interest not being identified during the scanning to identify one or more search-related points of interest;

determining a plurality of zones proximate the current location of the mobile device, each zone of the plurality of zones including at least one point of interest of the plurality of points of interest;

determining a location of the point of interest in an associated zone of the plurality of zones relative to the current location of the mobile device;

outputting to a speaker of the mobile device a plurality of three dimensional audio effects associated with the plurality of points of interest, the three dimensional audio effects of the plurality of three dimensional audio effects simulating a sound emitted from a direction and distance of an associated point of interest relative to the current location of the mobile device, at least one three dimensional audio effect of the plurality of three dimensional audio effects being at least partially determined based on the environmental condition associated with the current location of the mobile device;

receiving an indication of a selection of a destination point of interest of the plurality of points of interest in a zone of the plurality of zones;

determining a path from the current location of the mobile device to the location of the destination point of interest; and outputting to the speaker of the mobile device the three dimensional audio effect associated with the destination point of interest that indicates a correct direction of travel as the current location of the mobile device approaches the location of the destination point of interest.

12. The system of claim 11, wherein determining a location of the point of interest in an associated zone of the plurality of zones relative to the current location of the mobile device comprises:

determining a location of at least one point of interest by sending a web service request with an identifier associated with the at least one point of interest.

13. The system of claim 11, wherein receiving a search request comprises:

receiving a search request associated with a genre, wherein the genre includes at least one of a restaurant, a beverage facility, a grocery store, or a retail merchandise store.

14. The system of claim 11, wherein:

the three dimensional audio effects associated with the points of interest are provided via a web service including the three dimensional audio effects associated with the points of interest.

15. The system of claim 13, wherein scanning to identify one or more environment-related points of interest based on both the environmental condition associated with the current location and the search request comprises:

scanning to identify one or more environment-related points of interest based on both the environmental condition associated with the current location and the genre associated with the search request.

16. The system of claim 11, wherein each zone is a volume of points encapsulating the current location of the mobile device, the location of at least one point of interest, and points adjacent to a line between the current location of the mobile device and the location of the at least one point of interest.

17. The system of claim 11, wherein each zone is substantially in a shape of a cone.

18. A mobile device, comprising:

a processor for executing computer instructions; and memory storing computer instructions that, when executed by the processor, cause the mobile device to perform a method comprising:

receiving a search request;

determining a current location of a mobile device;

determining a context associated with the current location of the mobile device, the context including an environmental condition associated with the current location;

scanning to identify a plurality of points of interest proximate to the current location of the mobile device, including (1) scanning to identify one or more search-related points of interest based on the search request, and (2) scanning to identify one or more environment-related points of interest based on both the environmental condition associated with the current location and the search request, the one or more environment-related points of interest not being identified during the scanning to identify one or more search-related points of interest;

determining a plurality of zones proximate the current location of the mobile device, each zone of the plurality of zones including at least one point of interest of the plurality of points of interest;

determining a location of the point of interest in an associated zone of the plurality of zones relative to the current location of the mobile device;

outputting to a speaker of the mobile device a plurality of three dimensional audio effects associated with the plurality of points of interest, the three dimensional audio effects of the plurality of three dimensional audio effects simulating a sound emitted from a direction and distance of an associated point of interest relative to the current location of the mobile device, at least one three dimensional audio effect of the plurality of three dimensional audio effects being at least partially determined based on the environmental condition associated with the current location of the mobile device;

receiving an indication of a selection of a destination point of interest of the plurality of points of interest in a zone of the plurality of zones;

determining a path from the current location of the mobile device to the location of the destination point of interest; and outputting to the speaker of the mobile device the three dimensional audio effect associated with the destination point of interest that indicates a correct direction of travel as the current location of the mobile device approaches the location of the destination point of interest.

19. The mobile device of claim 18, wherein:

the current location of the mobile device is determined by triangulating mobile device signals.

20. The mobile device of claim 18, wherein scanning to identify one or more environment-related points of interest based on both the environmental condition associated with the current location and the search request comprises:

scanning to identify one or more environment-related points of interest based on both the environmental condition associated with the current location and a genre associated with the search request.

* * * * *